US006429588B1

(12) United States Patent
Guenther et al.

(10) Patent No.: US 6,429,588 B1
(45) Date of Patent: Aug. 6, 2002

(54) SODIUM HIGH-PRESSURE LAMP HAVING A STARTING AID

(75) Inventors: Klaus Guenther; Andreas Lembcke, both of Berlin (DE)

(73) Assignee: Patent-Treuhand-Gesellschaft fuer elektrische Gluehlampen mbH, Munich (DE)

( * ) Notice: Subject to any disclaimer, the term of this patent is extended or adjusted under 35 U.S.C. 154(b) by 0 days.

(21) Appl. No.: 09/511,946

(22) Filed: Feb. 24, 2000

(30) Foreign Application Priority Data

Mar. 16, 1999 (DE) ..... 199 11 727

(51) Int. Cl.[7] ..... H01J 61/54

(52) U.S. Cl. ..... 313/594; 313/595; 313/596; 313/570; 313/25; 313/670

(58) Field of Search ..... 313/595, 596, 313/570, 594, 25, 607, 204

(56) References Cited

U.S. PATENT DOCUMENTS 4,463,280 A 7/1984 Hammer et al. ..... 313/594
4,468,591 A 8/1984 Hammer et al. ..... 313/594
5,079,479 A * 1/1992 Weske et al. ..... 313/594
5,909,082 A * 6/1999 Speaker et al. ..... 313/570

FOREIGN PATENT DOCUMENTS

DE 2302685 7/1974 ..... H01J/61/54
EP 0592040 4/1994 ..... H01J/61/54
FR 2255706 7/1975 ..... H01J/61/90

* cited by examiner

*Primary Examiner*—Sandra O'Shea
*Assistant Examiner*—Guiyoung Lee
(74) *Attorney, Agent, or Firm*—William H. McNeill

(57) ABSTRACT

In the case of a sodium high-pressure lamp having a ceramic, tubular discharge vessel (1), an electrically conducting starting aid is fitted outside on the discharge vessel. Said aid comprises an axially parallel longitudinal strip (4) of prescribed width B to which a partial circle (6) surrounding the discharge vessel is attached approximately at the level of each electrode (2).

9 Claims, 4 Drawing Sheets

SODIUM HIGH-PRESSURE LAMP HAVING A STARTING AID

TECHNICAL FIELD

The invention proceeds from a sodium high-pressure lamp in accordance with the preamble of claim 1. In particular, these are sodium high-pressure lamps having a starting aid fitted outside on the ceramic discharge vessel.

PRIOR ART

A sodium high-pressure lamp having an external starting aid is already known from EP-A 592 040. When sodium high-pressure lamps are started, the electric flashover is performed by a high-voltage pulse which is applied between the two electrodes located in the ceramic discharge vessel. The absolute value of this high voltage is determined by the geometrical dimensions of the discharge vessel and, in particular, by the cold filling pressure of the inert gas (mostly xenon) located therein. A high cold filling pressure leads, on the one hand, to high light yields and good maintenance, but it requires, on the other hand, correspondingly high starting voltages, which are not readily available.

An electrically conducting, metallic starting aid fitted outside on the discharge vessel provides a remedy. It is either a separate part or a strip which is sintered onto the ceramic discharge vessel. The separate part can take the form of a wire bearing against the discharge vessel, or of a helix made from high-melting metal. It is pressed on by means of a bimetal. The bimetal lifts this starting aid off the discharge vessel during operation. This is required, since the starting aid is electrically connected to one of the two electrodes, and there is therefore present between the starting aid and the second electrode a high electric field strength which leads to the diffusion of the sodium through the wall of the discharge vessel. However, the bimetal has the disadvantage that it is difficult to mount. Moreover, after some time it can tire or become detached, and thus lead to premature lamp failures.

A bimetal is dispensed with in the case of starting aids without direct electrical contact with the line voltage. Instead of this, use is made of axial starting strips and a closed ring around each electrode. The starting aid is coupled in this case only capacitively to the starting pulse, this coupling depending on the area of the starting aid and the spacing between the starting aid and electrode. The diffusion of sodium is prevented since said aid is at a freely floating potential.

In the case of a capacitive starting aid without contact, the potential of the starting aid depends on the voltage divider which is formed by the capacitances between the starting aid and the electrodes. A role is also played by high-resistance, electrical connections between the starting aid and the electrodes owing to the finite conductivity of the ceramic and along the ceramic. In the case of a symmetrical design, the potential of the starting aid will be in the middle between the frame and the potential of the starting pulse. It then follows that only half the voltage value is available for the flashover between the electrode and wall of the discharge vessel. The flashover can occur both between the frame electrode and the wall with the starting aid, and between the electrode at high voltage and the wall with the starting aid. The point is that there is a similar potential difference in both cases.

The flashover forms in like manner in both cases, that is to say in the case both of direct and of capacitive coupling. Initially, a discharge is produced between the first electrode, at which the high-voltage pulse is present, and the adjacent site of the ceramic wall, on which the starting aid is seated on the outside. The discharge propagates along the starting aid on the ceramic wall, until the flashover for the second electrode finally occurs.

Without direct electrical contact with the line voltage, because of the capacitive coupling a potential is set up at the starting aid which is between that of the high-voltage pulse at the first electrode and the zero potential of the second electrode. The potential difference between the high-voltage pulse and the starting aid is therefore less than when the starting aid is at the potential of one of the electrodes. That is to say, the starting voltage requirement is substantially increased in the case of a starting aid without contact.

A particular disadvantage of the sintered-on, capacitive starting aid known from EP-A 592 040 and having two rings resides in that applying the rings is a complicated procedure in production engineering, and this occasions high costs. Moreover, the required absolute value of the starting voltage is relatively high. On the other hand, a simple, cost effective starting strip does not start reliably enough, and the required absolute value of the starting voltage is still substantially higher than in the case of the ring solution.

SUMMARY OF THE INVENTION

It is the object of the present invention to provide a sodium high-pressure lamp in accordance with the preamble of claim 1 which starts without any problem and whose starting aid can be produced simply and cost effectively.

This object is achieved by means of the characterizing features of claim 1. Particularly advantageous refinements are to be found in the dependent claims.

The invention dispenses with a closed ring (complete circle) around the electrode at the end of the starting strip.

Instead of this, an elongated starting strip is widened at the level of each electrode by a coupling surface so that the capacitance which is formed by the electrode with the coupling surface is substantially increased. As a result, there is a substantial rise in the charge quantity which flows between the electrode and the inner surface of the ceramic tube upon application of the starting pulse, and a stronger ionization of a gas is produced. The coupling surface has a maximum transverse extent corresponding to a center angle $\alpha$ of at most 180°, in particular 50° to 120°.

By contrast with the starting strip with two conductive rings, this design has the advantage of producing an asymmetric field strength distribution on the electrode. For this reason, the voltage required for a flashover is substantially less than in the case of the symmetrical ring arrangement. The second design with the transverse strips is intended to avoid the loss in field strength which can occur owing to the skewed position of the electrodes, which cannot be completely ruled out in the production process: the minimum electrode-transverse strip spacing responsible for the field strength produced on the electrode increases only insubstantially even when the electrode is situated off the axis, with the result that the scatter thereby caused in the starting voltage is reduced. An advantageous configuration of the starting aid consists in that the coupling surfaces are constructed at both ends of the starting strip as conductive transverse strips which extend over less than half the circumference of the discharge tube.

The electrode advantageously comprises a shaft of given diameter D and a wider part, in particular a helix or a sphere, of greater transverse dimension, the coupling surface being fitted in the region of the wider part.

The coupling surface according to the invention increases the capacitance with respect to the electrode and produces a particularly powerful starting spark. Moreover, it is much easier to apply than a complete circle. Detailed investigations have shown that given an area of the same magnitude the starting voltage required for a complete circle is greater than in the case of a partial circle, in particular with a center angle $\alpha$ of less than 180°. It is to be surmised that the missing symmetry of this arrangement of the starting aid and electrode gives rise to an inhomogeneous field distribution with particularly high peak field strengths on the electrode, which exceed the peak field strengths of the symmetrical arrangement (with rings) by a few percent (up to 5%). The larger peak field strengths facilitate a flashover, and therefore the required starting voltage is reduced. The smaller the center angle selected, the greater the asymmetry, and therefore the peak field strength. In the case of very small center angles below 45°, however, the capacitive coupling declines once again. A center angle of 50 to 120°is therefore optimum. The coupling surface can preferably have a square, elliptic or circular surface and, in particular, be a transverse strip in the shape of a partial circle.

It holds in essence that: the larger the capacitive area in the vicinity of a first electrode, the more easily the flashover can occur between this electrode and the wall of the discharge vessel.

The starting aid presented here can be produced simply and cost effectively, for example by means of a screen printing or stamp printing method, without the need for complicated manipulation or rotation of the discharge vessel. In addition, the starting voltage is lower in conjunction with the same coupling surface at the strip ends by comparison with the prior art. The reason for this is the inhomogeneity of the electric field strength between the coupling surface and electrode. By contrast, the known ring-shaped arrangement produces a lower electric field overall at the electrode because of its radial symmetry. Consequently, the starting voltage applied can be lower in the case of the present invention, in order to produce the field strength required for the flashover at the electrode.

FIGURES

The invention is to be explained in more detail below with the aid of a plurality of exemplary embodiments. In the drawing:

FIG. 1 shows a discharge vessel for a sodium high-pressure lamp, in a side view (FIG. 1*a,* sectioned) in plan view (FIG. 1*b*) and in cross section (FIG. 1*c*), the starting aid having a square coupling surface;

FIG. 2 shows a representation of the prior art;

FIG. 3 shows a further exemplary embodiment of a discharge vessel with a transverse strip at the ends of the longitudinal strip as a coupling surface;

FIG. 4 shows a further exemplary embodiment of coupling surfaces; and

FIG. 5 shows two further exemplary embodiments of coupling surfaces.

Figure 1A:
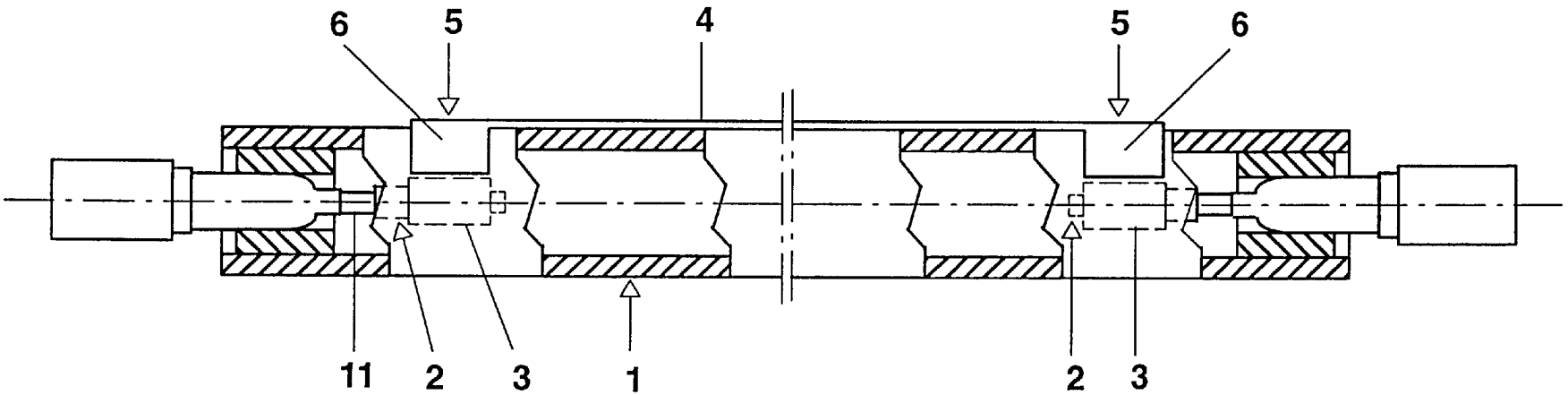
FIG. 1 shows a discharge vessel 1 made from alumina ceramic, for a sodium high-pressure lamp with a power of 70 W, which has a spacing between the two electrodes 2 of 37 mm, with a wall thickness of 0.6 mm and with a filling made from xenon at a cold filling pressure of 150 mbar, as well as sodium. In this case, a rod-shaped starting strip 4 of length 40 mm and with a width B of 0.8 mm is used. Its surface F is 32 mm$^2$. A coupling surface 6 is fitted at the two ends 5 of the starting strip 4 at the level of each electrode 2 transverse to the starting strip, specifically at the level of the helix 3 pushed onto the shaft 11 of the electrode.
Figure 1B:
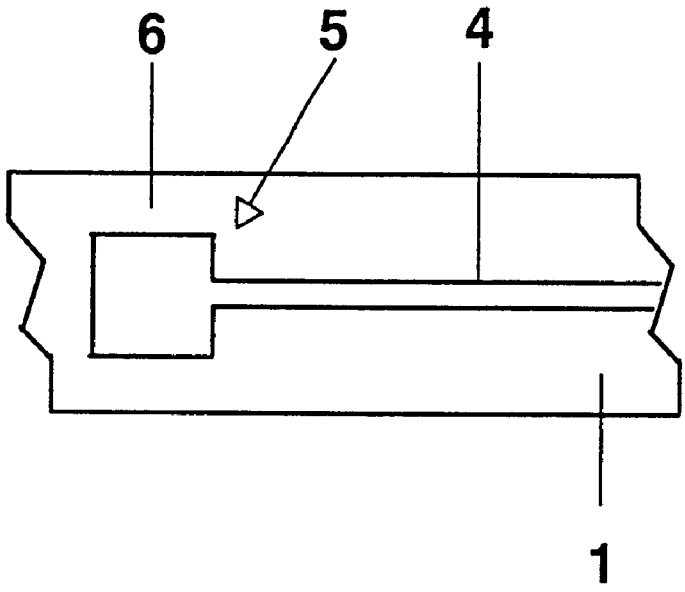
Figure 1C:
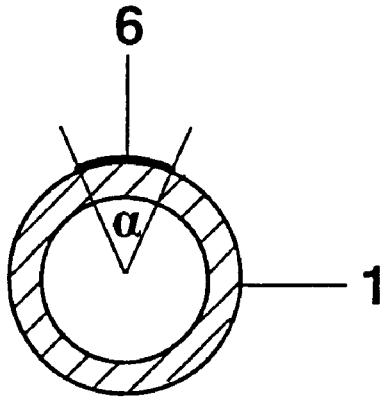
Figure 2:
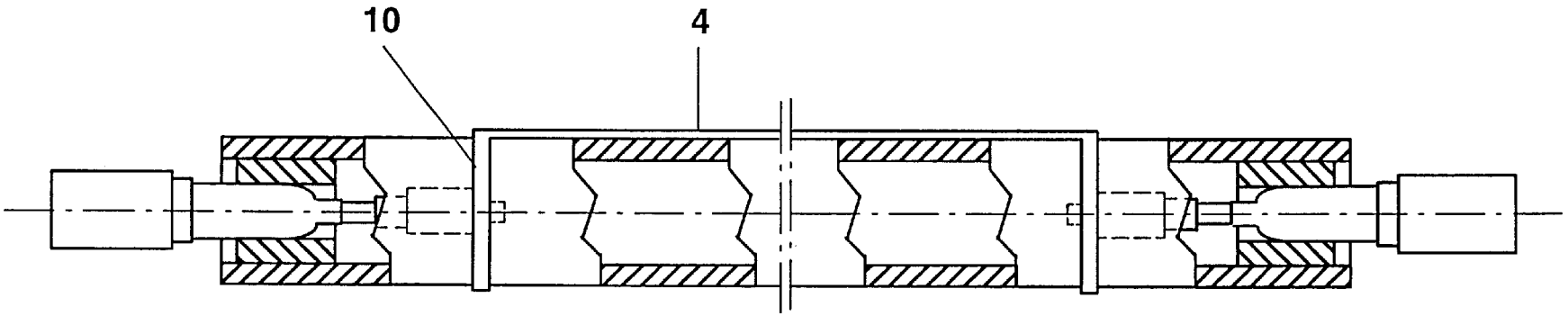

In this first exemplary embodiment, two essentially square coupling surfaces 6 with an edge length of 3 mm are fitted at both ends of the starting strip. These correspond approximately to a partial circle with a center angle $\alpha$×50°. The starting voltage of this arrangement (measurements C1, C2 in Table 1) were compared with the prior art, in which, on the one hand, a starting aid was dispensed with in the case of an identical discharge vessel (measurement A) or only the starting strip of the same size was used as a starting aid (measurement B) or, in addition, a ring-shaped transverse strip 10 is positioned at the end of the starting strip 4 of the same size in accordance with FIG. 2 (measurements D1, D2).

Figure 3:
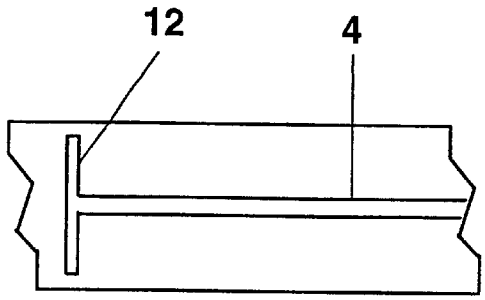

In a second exemplary embodiment in accordance with FIG. 3, the coupling surface 12 was shaped at each end of the starting strip 4 such that it forms a narrow transverse strip. The latter forms approximately a partial circle 6 with a center angle of $\alpha$=120°.

The dimensions of the systems were selected in each case such that the coupling surface of the starting aid was of the same size in both cases. The starting aid is coupled here only capacitively in all cases. The starting pulse is applied to the first electrode, while the second electrode is at zero potential. Measurement results of the starting aid with a partial circle at the ends are compared in Table 1 with the other versions from the prior art.

The result may be interpreted such that in the case of a small coupling surface of the transverse strip (4 to 20 mm$^2$), the effect evoking starting is so small that no differences are to be detected between the partial circle and ring. In the case of a larger surface (more than 20 mm$^2$) of the transverse strip, the partial circle is superior to the ring, since the starting voltage is markedly reduced.

TABLE 1

Starting behavior for various starting aid designs

| Embodiment | Area of the transverse strip (in mm$^2$) | Starting voltage (in kV) |
|---|---|---|
| A: Discharge vessel without starting aid | 0 | 2.80 |
| B: Discharge vessel with starting strip | 0 | 1.96 |
| C1: Discharge vessel with starting strip and partial circle | 9 | 1.90 |
| D1: Discharge vessel with starting strip and complete circle | 9 | 1.90 |
| C2: Discharge vessel with starting strip and partial circle | 65 | 1.76 |
| D2: Discharge vessel with starting strip and complete circle | 65 | 1.80 |

Figure 4:
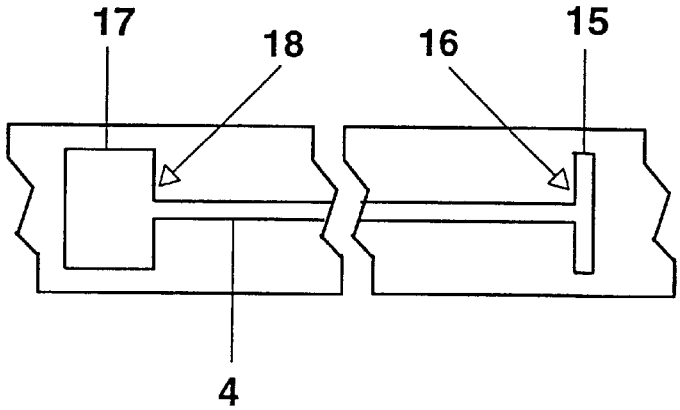

In another exemplary embodiment (FIG. 4), the surface of the partial circle 15 at the second end 16 of the starting strip 4 is only half as large as the surface of the partial circle 17 at the first end 18, since a smaller starting voltage suffices for the flashover at the second end 16 after the lamp has started at the first electrode. The optical shading is thus less.

Figure 5:
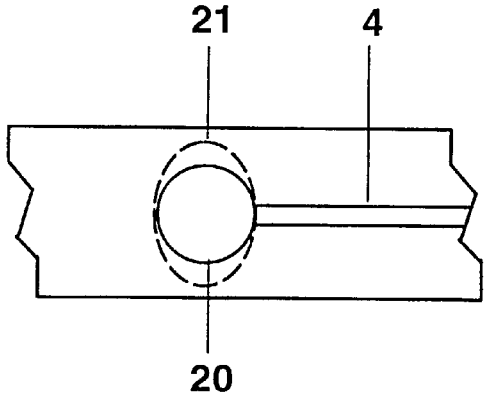

A further exemplary embodiment is shown in FIG. 5. Here, the transverse strip is not in the shape of a rectangle, but in that of a circle 20 or an ellipse 21 (drawn in with dashes). In both cases, the center of the transverse strip 20 or 21 is situated at the end of the starting strip 4.

Particularly in the case of specific optical requirements, the transverse strip can also be arranged asymmetrically relative to the starting strip.

What is claimed is:

1. A sodium high-pressure lamp having a ceramic, tubular discharge vessel, in which two electrodes are situated opposite one another, an electrically conducting starting aid being fitted outside on the discharge vessel, wherein the starting aid comprises an axially parallel longitudinal strip of prescribed width to which there is attached approximately at the level of each electrode a coupling surface which partially surrounds the discharge vessel and has a maximum transverse extent, corresponding to a center angel $\alpha$ of at most 180°, in particular 50 ° to 120 °.

2. The sodium high-pressure lamp as claimed in claim 1, wherein the coupling surface covers at least 4 $mm^2$.

3. The sodium high-pressure lamp as claimed in claim 1, wherein the coupling surface is constructed as a transverse strip of given length and width.

4. The sodium high-pressure lamp as claimed in claim 1, wherein the coupling surface covers at most 70 $mm^2$.

5. The sodium high-pressure lamp as coed in claim 1, wherein the coupling surface has a shape selected from a partial or complete circle or an ellipse.

6. The sodium high-pressure lamp as claimed in claim 1, wherein the coupling surface is arranged symmetrically relative to the longitudinal strip.

7. The sodium high-pressure lamp as claim 1, wherein the coupling surface is fitted in each case on the end of the longitudinal strip .

8. The sodium high-pressure lamp as claimed in claim 1, wherein the filling in the discharge vessel contains sodium and xenon, the cold filling pressure of the xenon being at least 100 mbar.

9. The sodium high-pressure lamp as claimed in claim 1, wherein the electrode comprises a shaft of given diameter D and a part, in particular a helix or a sphere to create a wider part, of greater transverse dimension than the shaft, the coupling surface being fitted in the region of the wider part.

* * * * *